United States Patent [19]

Deutsch

[11] Patent Number: 4,778,710

[45] Date of Patent: Oct. 18, 1988

[54] ONE-PIECE SKI EDGE WITH INTEGRATED TIP AND/OR END PROTECTION

[76] Inventor: Friedrich Deutsch, Archenweg 40, A-6020 Innsbruck, Austria

[21] Appl. No.: 718,378

[22] Filed: Apr. 1, 1985

[30] Foreign Application Priority Data

Apr. 16, 1984 [AT] Austria ..... 1262/84

[51] Int. Cl.[4] ..... B32B 23/02; A63C 5/04

[52] U.S. Cl. ..... 428/192; 280/608

[58] Field of Search ..... 280/608; 428/192

[56] References Cited

U.S. PATENT DOCUMENTS

| | | | |
|---|---|---|---|
| 3,083,977 | 4/1963 | Dunston | 280/608 |
| 3,580,596 | 5/1971 | Volkl | 280/608 |
| 3,700,252 | 10/1972 | Schultes | 280/608 |
| 3,751,054 | 8/1973 | Deutsch | 280/608 |
| 3,907,314 | 9/1975 | Tanahashi | 280/608 |

FOREIGN PATENT DOCUMENTS

| | | | |
|---|---|---|---|
| 2300274 | 8/1973 | Fed. Rep. of Germany | 280/608 |
| 2327424 | 12/1974 | Fed. Rep. of Germany | 280/608 |
| 261458 | 4/1968 | Switzerland | 280/608 |

*Primary Examiner*—John E. Kittle
*Assistant Examiner*—Patrick J. Ryan
*Attorney, Agent, or Firm*—Lorusso & Loud

[57] ABSTRACT

A ski edge whose vertical flange and horizontal flange of the ski edge portions extend around the ski tip, the horizontal flange having a cutout in the region of the ski tip. The ski edge is one piece whose side edge portions are divided into successive sections in which the vertical flange is divided by slits, the individual successive sections are connected to one another by the horizontal flange. In the region of the ski tip and/or of the ski end, the vertical flange extends continuously and is, hence, not divided by slits, thus forming a strong tip and/or end protection.

15 Claims, 2 Drawing Sheets

ONE-PIECE SKI EDGE WITH INTEGRATED TIP AND/OR END PROTECTION

FIELD AND BACKGROUND OF THE INVENTION

The invention relates to a ski edge having a vertical flange and a horizontal flange extending around the tip of the ski from one longitudinal side portion of the ski to the opposite longitudinal side portion, said horizontal flange being provided with a cutout in the region of the ski tip.

DESCRIPTION OF THE PRIOR ART

A ski edge divided into three sections is already known in which the horizontal flange and the vertical flange of the front portion of the ski edge extend around the ski tip, the horizontal flange having a V-shaped cutout in the region of the ski tip.

It is further known to provide a ski with two edges arranged in the side portions of the ski and to provide as a protection for the tip and/or end of the ski separate protective members for the tip and/or end of the ski embracing the shovel tip and/or ski end. In this arrangement, notch-effects occur in the side portions, in particular in the transition portions between the separate protective member of the ski tip and the ski edges. In said transition region, the ski edge and/or the end of the separate protective member of the ski tip may loosen and project from the lower side of the ski. It is also possible to weld the separate protective member of the ski tip to the side edges but in the case of edges of hardened and tempered steel, the treated surface gets damaged at the welds. Moreover, additional operational steps are required for said welding.

To eliminate this disadvantage, it has already been suggested to provide a continuous ski edge which is one piece and comprises an integrated protection for the tip and/or end of the ski. Such continuous ski edges have, however, a low extensibility in their side portions in the longitudinal direction of the edge, and hence great tensions occur in the ski edges when the ski is under stress, and vibrations of the ski following an impact for example stop only after some time.

SUMMARY OF THE INVENTION

It is therefore the object of the invention to provide a ski edge, which is one piece, with an integrated protection of the tip and/or end of the ski, which can easily be produced and has good working properties, and whose side portions have an increased extensibility in the longitudinal direction of the ski, also guaranteeing sufficient strength of the integrated protection of the tip and/or end of the ski.

According to the invention this is attained in that in the region of the side portions of the ski, the vertical flange is divided in successive sections by spaced slits running transversely to the longitudinal direction of the edge, said successive sections being connected to one another by the horizontal flange, that in the region of the tip and/or of the end ofthe ski the vertical flange is free of slits, thus extending continuously in said region of the tip or of the end of the ski, and that the whole ski edge is one piece.

Because of the slits arranged in the vertical flange and running transversely to the longitudinal direction of the edge, the edge according to the invention has—when compared to continuous ski edges without slits—increased extensibility in the longitudinal direction of the edge. On the other hand, the vertical flange which extends continuously in the region of the tip and/or end of the ski gives sufficient strength to said regions. Furthermore, the continuous vertical flange which is not divided by slits obviates the formation of gaps in spite of the great curvature of the ski edge in said regions.

Advantageously the vertical flange has substantially the same structure in the region of the tip and/or of the end of the ski as well as in the region of the side edges. An edge having this structure can particularly easily be produced of one profiled edges strip.

To be able to facilitate bending of the ski edges in the region of the tip and/or end of the ski, an advantageous embodiment of the invention provides that the ski edge comprises in the region of the ski tip and/or in the corner regions of the ski end the vertical flange only.

This can be attained in that a horizontal flange element which is generally used with edges whose vertical flanges are divided into successive sections is omitted in the region of the ski tip and used in the side portions of the edge to hold the slitted vertical flange together.

A particularly advantageous method of producing a ski edge according to the invention is characterized in that a straight and profiled running edge strip, the length of which corresponds to the total length of the ski edge, is bent substantially U-shaped in the region of its center, by means of bending irons, preferably after having removed a part of the horizontal flange in the region of the center of edge strip, whereupon in the region of said side portions the outwardly arranged vertical flange is provided with spaced slits running transversely to the longitudinal direction of the edge strip, after which in the region of the tip and/or of the end of the ski, where the vertical flange is free of spaced slits, the edge strip is fitted on the final form of the shovel and/or of the end of the ski, respectively, by means of bending irons, preferably without bending up the ski edge according to the form of the shovel of the ski before the definitive mounting to the ski.

According to this method, a straight and profiled edge strip, which can easily be produced, is used, and relatively simple bending tools may be used which shape the edge strip in one plane only. With a ski edge according to the invention which is one piece with an integrated tip and/or end protection it is not necessary—although possible—to bend up the ski edge in the region of the shovel before being mounted to the ski. The pressure of a gluing press for example will be sufficient to adapt the ski edge permanently to the shovel shape of the ski.

BRIEF DESCRIPTION OF THE FIGURES OF THE DRAWING

Below the embodiments of the invention will be described in more detail with reference to the drawing, in which

FIG. 9*a* is a view of a ski shown in FIG. 4 with the horizontal flange elements bent up.

FIG. 9*b* is a sectional view taken along line E–F of FIG. 9*a*.

Figure 1:
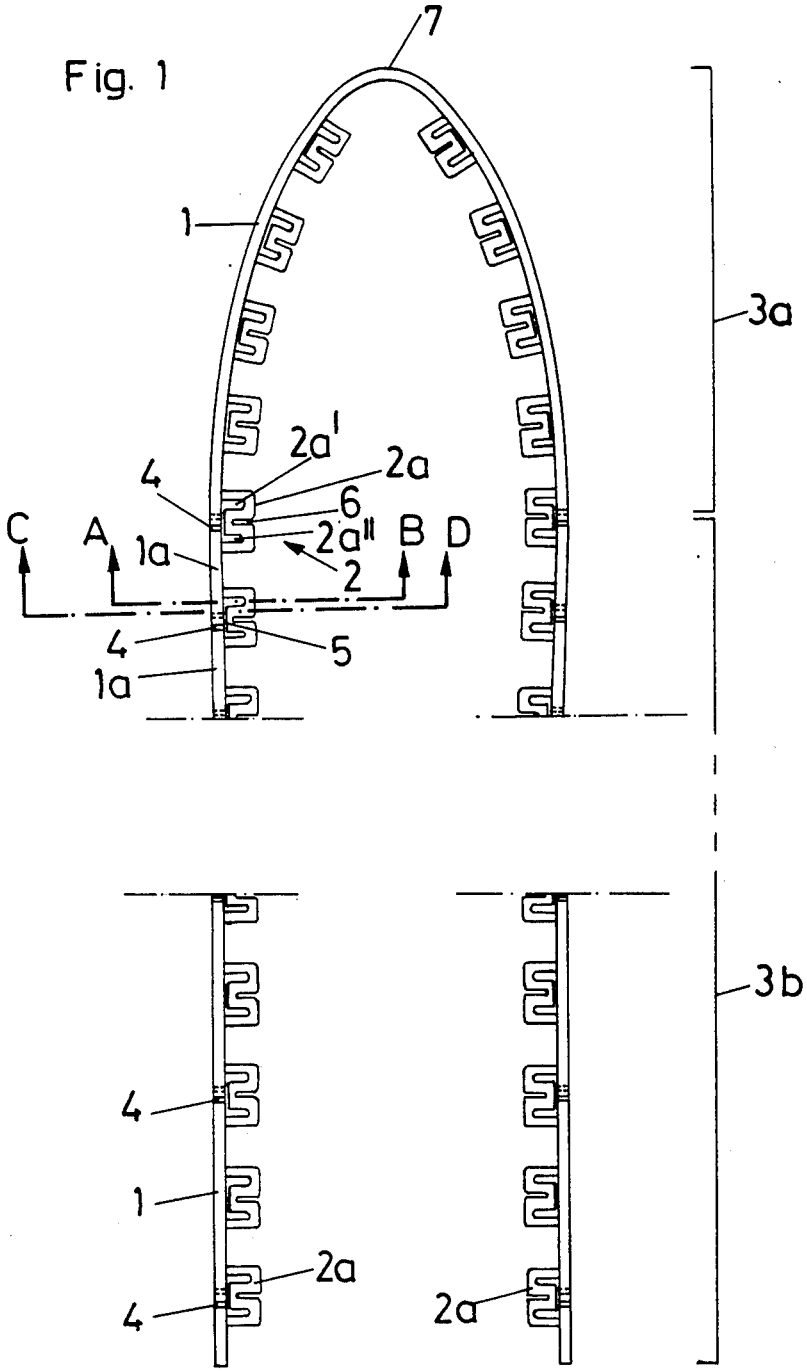
FIG. 1 shows a view from below of an embodiment of the ski edge according to the invention.

The ski edge illustrated in FIG. 1 which is one piece is made of steel and comprises a vertical flange 1 and a horizontal flange 2. The horizontal flange 2 is formed by the flange elements 2*a* which are provided with cutouts 2*a*′ and 2*a*″. According to the invention, the vertical flange 1 is divided in successive sections 1*a* by slits 4 running transversely to the longitudinal direction of the edge, said successive sections being connected to one another by the horizontal flange 2, more precisely by the flange elements 2*a*. Each slit 4 branches out into two slits 5 running in the horizontal flange 2, and the inner longitudinal border of the horizontal flange has an incision 6 opposite each slit 4. By means of the aforedescribed structure of the edge in the side region 3*b* sufficient extensibility in the longitudinal direction is obtained, and furthermore a displacement of the individual successive sections 1*a* and their deviation from the longitudinal direction of the edge is substantially obviated during the production process as well as in the mounted condition. In the region 3*a* of the ski tip 7, the vertical flange 1 is, according to the invention, free of slits. The horizontal flange 2 has in this arrangement substantially the same structure as in the side portions 3*b* of the ski edge. Only in the region of the ski tip 7, advantageously no edge element 2*a* is provided so that bending of the ski edge in this region is facilitated. In the region of the ski tip 7, where the vertical flange 1 is not divided by slits 4, the guiding function of the flap-shaped flange members 2 lying behind the slits 5 is not required, and the flap-shaped flange members 2 can be upwardly bent in the region of the slits 5. This allows improved anchoring of that part of the ski edge to the ski which serves as a protection for the tip and/or end of the ski.

Figure 2:
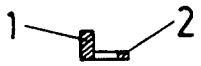
FIG. 2 shows a sectional view along A–B of FIG. 1.

FIG. 2 shows a sectional view along A–B of FIG. 1 of the profile of the ski edge illustrated in FIG. 1; like in FIG. 1, the side of the vertical flange 1 which is the lower side in the mounted condition is directed upwardly. The horizontal flange 2 extends at said intersection A–B directly only at the inner longitudinal border of the edge because of the cutouts 2*a*′ illustrated in FIG. 1.

Figure 3:
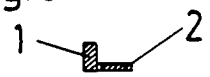
FIG. 3 shows a sectional view along C–D of FIG. 1.

FIG. 3 shows a sectional view which runs closely beside a slit 4 of the vertical flange 1, of the horizontal flange extending to the vertical flange 1, except for the slit 5 illustrated in FIG. 1.

Figure 4:
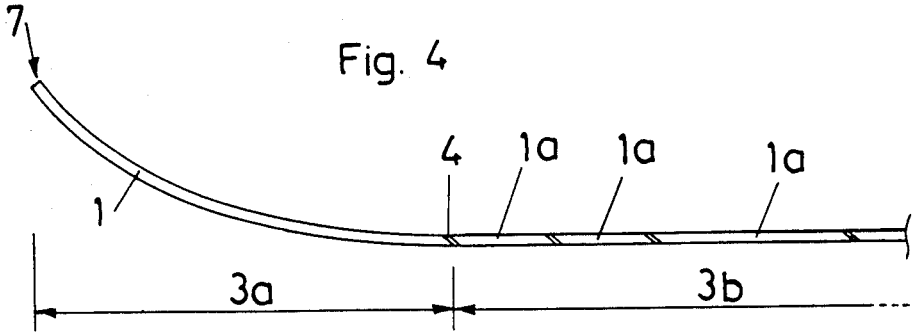
FIG. 4 shows a side view of the shovel region of a ski edge according to the invention in bent-up condition, FIGS. 5 to 7, each, show views from below of further embodiments of the horizontal flanges.

FIG. 4 shows a side view of the shovel region of a ski ede according to the invention in the bent-up condition. In region 3*a* of the ski tip 7, the vertical flange 1 is not divided by slits. In the side region 3*b*, however, said vertical flange is divided into successive sections 1*a* by the slits 4 being downwardly inclined towards the rear ski end.

Figure 5:
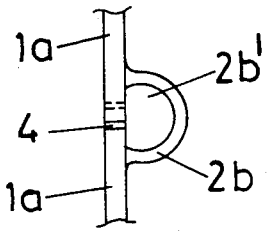
Figure 6:
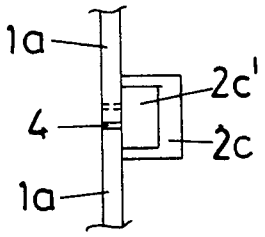
Figure 7:
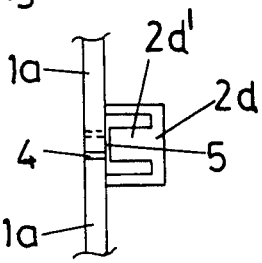

Apart form the horizontal flange elements 2*a* illustrated in FIGS. 1 to 3, simpler flange elements 2*b*,2*c* as shown from below in FIGS. 5 and 6, may also be used. The flange elements 5 and 6 illustrated in FIGS. 5 and 6 are bent and connect the successive sections 1*a* to one another, the flange element 2*b* illustrated in FIG. 5 enclosing a substantially round cutout 2*b*′, whereas the flange element 2*c* illustrated in FIG. 6 encloses a rectangular cutout 2*c*′. The flange element 2*d* shown in FIG. 7 is in the side regions 3*b* provided with a flap-shaped flange member 2*d*′, which is directed towards the slit 4 and extends to the sections 1*a*, except for the small slit 5. Thus, guiding of the successive sections 1*a* is obtained and extensibility of the ski edge in the longitudinal direction is preserved at the same time so that said sections 1*a* can hardly deviate from the longitudinal direction of the ski edge. If said flange elements 2*d* are also used in the region of the ski tip and/or ski end, the guiding function of the flap-shaped flange member 2*d*′ is not required because the vertical flange is in this region not divided by slits, and the slits 5 allow bending up of said flange members 2*d*′, thus permitting an improved connection between ski body and ski edge in the region of the ski tip and/or ski end.

Figure 8A:
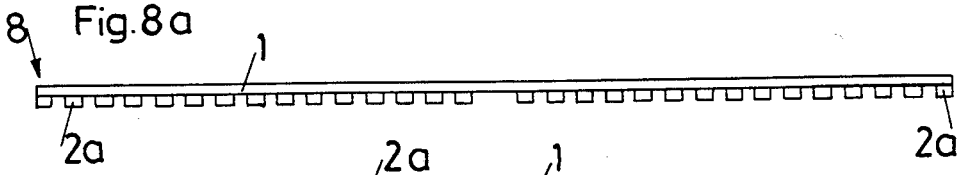
FIGS. 8*a* to 8*d* show views from below of an embodiment of the ski edge according to the invention in the individual stages of production.

For the production of the embodiment of the ski edge according to the invention, a straight profiled edge strip 8 is used which comprises a continuous vertical flange 1 and flange elements 2*a* and whose length corresponds to the full length of the ski. To facilitate bending of the edge in the region of the ski tip, a flange element 2*a* is removed from the center of the edge strip 8, the edge strip 8 thus getting the shape illustrated in FIG. 8*a*.

Figure 8B:
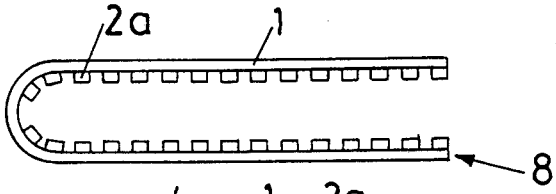
Figure 8C:
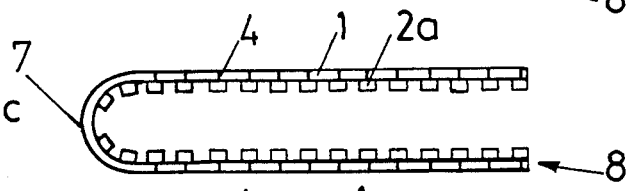
Figure 8D:
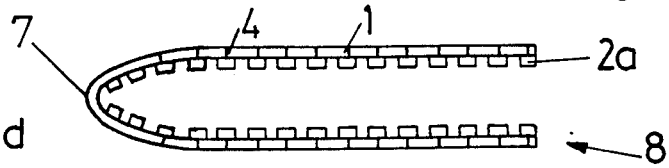

In the following step of the operation the edge strip 8 is bent in its center region to take the U-shape illustrated in FIG. 8*b*. The bending operation is carried out by bending tools with the edge strip 8 being in cold or hot condition. According to the invention, the vertical flange 1 is in a further step of the operation divided in successive sections 1*a*, the vertical flange 1 not being divided by slits 4 in the region of the ski tip 7. After this step of the operation, the ski edge has the shape illustrated in FIG. 8*c*. In a final step, the shape of the ski edge which corresonds to the final shovel shape and is shown in FIG. 8*d* is obtained by bending tools, in which step bending up according to the required shovel shape is not necessary because the pressure of a gluing press for example which is used for mounting the ski edge to and into the ski is sufficient to obtain a permanent upward bending up of the ski edge.

The invention is not restricted to the above-described embodiments. The ski edge may, for example, extend around the ski end without being divided into successive sections. It will further be possible to vary the number of and the interspaces between the slits in the side portions of the ski edge over the length of the ski. The shape of the horizontal flanges is not restricted to the above-described shapes. On principle, the ski edge according to the invention may also be used as upper ski edges.

What is claimed is:

1. A ski edge having a vertical flange and a horizontal flange extending around the tip of the ski from one longitudinal side portion of the ski to the opposite longitudinal side portion, said horizontal flange being provided with a cutout in the region of the tip of the ski, wherein in the region of said side portions of the ski said vertical flange is divided in successive vertical flange elements by spaced separating slits running transversely to the longitudinal direction of the edge, said successive separate vertical flange elements being connected to one another by said horizontal flange, wherein in the region of the shovel said vertical flange is free of spaced slits, thus extending continuously in said region of the shovel, and wherein the whole ski edge is one piece.

2. A ski edge according to claim 1, comprising at the tip of the ski said vertical flange only.

3. A ski edge according to claim 1, comprising at the corners of the ski end said vertical flange only.

4. A ski edge according to claim 1, comprising at the tip of the ski and at the corners of the ski end said vertical flange only.

5. A ski edge according to claim 1, wherein each slit of said vertical flange branches out into at least two branches of said horizontal flange of the edge, and wherein said branches of said horizontal flange of elements are also arranged in the region of the shovel respectively.

6. A ski edge according to claim 1, wherein said horizontal flange comprises a plurality of individual elements that are, at least partially, bent up as a whole in the region of the shovel.

7. Method of producing a ski edge, wherein a straight and profiled running edge strip, the length of which corresponds to the total length of the ski edge, is bent substantially U-shaped in the region of its center by means of bending irons, after having removed a part of the horizontal flange in the region of the center of said edge strip, whereupon in the region of said side portions the outwardly arranged vertical flange is provided with spaced slits running transversely to the longitudinal direction of said edge strip, after which in the region of the tip and/or of the end of the ski, where said vertical flange is free of spaced slits, said edge strip is fitted on the final form of the shovel and/or the end of the ski, respectively, by means of bending irons, without bending up the ski edge according to the form of the shovel of the ski before the definitive mounting to the ski.

8. Method according to claim 7, wherein the shaping of said running edge strip is carried out in heated condition.

9. A ski edge according to claim 1, wherein each slit of said vertical flange branches out into at least two branches of said horizontal flange of the edge, whereby the inner longitudinal border of each of said horizontal flange elements has an incision opposite each slit of said vertical flange, and wherein said horizontal flange elements are also arranged in the region of the shovel respectively.

10. Method of producing a ski edge wherein a straight and profiled running edge strip, the length of which corresponds to the total length of the ski edge, is bent substantially U-shaped in the region of its center by means of bending irons, whereupon the region of said side portions of the outwardly arranged vertical flange is provided with spaced slits running transversely to the longitudinal direction of said edge strip, after which in the region of the shovel, where said vertical flange is free of spaced slits, said edge strip is fitted on the final form of the shovel, respectively, by means of bending irons.

11. A ski edge having a vertical flange and a horizontal flange extending around the tip of the ski from one longitudinal side portion of the ski to the opposite longitudinal side portion, said horizontal flange being provided with a cutout in the region of the tip of the ski, wherein in the region of said side portions of the ski said vertical flange is divided in successive vertical flange elements by spaced separating slits running transversely to the longitudinal direction of the edge, said successive separate vertical flange elements being connected to one another by said horizontal flange, wherein in the region of the end of the ski said vertical flange is free of spaced slits, thus extending continuously in said region of the end of the ski, and wherein the whole ski edge is one piece.

12. A ski edge according to claim 1, wherein each slit of said vertical flange branches out into at least two branches of said horizontal flange of the edge, and wherein said branches of said horizontal flange elements are also arranged in the region of the end of the ski respectively.

13. A ski edge according to claim 1, wherein said horizontal flange comprises a plurality of individual elements that are, at least partially, bent up as a whole in the region of the end of the ski.

14. A ski edge according to claim 1, wherein each slit of said vertical flange branches out into at least two branches of said horizontal flange of the edge, whereby the inner longitudinal border of each of said horizontal flange elements has an incision opposite each slit of said vertical flange, and wherein said horizontal flange elements are also arranged in the region of the end of the ski respectively.

15. Method of producing a ski edge wherein a straight and profiled running edge strip, the length of which corresponds to the total length of the ski edge, is bent substantially U-shaped in the region of its center by means of bending irons, whereupon the region of said side portions of the outwardly arranged vertical flange is provided with spaced slits running transversely to the longitudinal direction of said edge strip, after which in the region of the end of the ski, where said vertical flange is free of spaced slits, said edge strip is fitted on the final form of the end of the ski, respectively, by means of bending irons.

* * * * *